US007909481B1

(12) United States Patent
Zhang et al.

(10) Patent No.: US 7,909,481 B1
(45) Date of Patent: Mar. 22, 2011

(54) LED LIGHTING DEVICE HAVING IMPROVED COOLING CHARACTERISTICS

(75) Inventors: Jonathan Yu Zhang, Saratoga, CA (US); Justin Derek Ouyang, Arcadia, CA (US)

(73) Assignee: IMG Lighting, Inc., Saratoga, CA (US)

( * ) Notice: Subject to any disclaimer, the term of this patent is extended or adjusted under 35 U.S.C. 154(b) by 0 days.

(21) Appl. No.: 12/574,060

(22) Filed: Oct. 6, 2009

(51) Int. Cl.
*F21V 29/00* (2006.01)

(52) U.S. Cl. ..... 362/249.02; 362/294; 362/373

(58) Field of Classification Search ..... 362/545, 362/249.02, 311.02, 547, 218, 294, 373
See application file for complete search history.

(56) References Cited

U.S. PATENT DOCUMENTS

| | | | | |
|---|---|---|---|---|
| 2005/0201098 | A1* | 9/2005 | DiPenti et al. | 362/294 |
| 2006/0285325 | A1 | 12/2006 | Ducharme | |
| 2008/0062703 | A1 | 3/2008 | Cao | |
| 2008/0089079 | A1* | 4/2008 | Gunnewig et al. | 362/470 |
| 2008/0225544 | A1* | 9/2008 | Fujiwara et al. | 362/538 |
| 2009/0147521 | A1* | 6/2009 | Zhang et al. | 362/294 |
| 2009/0154168 | A1* | 6/2009 | Zhang et al. | 362/310 |

* cited by examiner

*Primary Examiner* — Laura Tso
(74) *Attorney, Agent, or Firm* — Xin Wen

(57) ABSTRACT

An LED light bulb includes a base member and one or more light emitting diodes mounted on the base member and in thermal communication with the base member. The one or more light emitting diodes are configured to emit light. A top-mount member is in thermal communication with the base member. The top-mount member includes a reflective surface configured to reflect the light emitted by the one or more light emitting diodes in predetermined directions. The top-mount member includes one or more cooling members configured to dissipate heat generated by the one or more light emitting diodes to the ambient environment.

15 Claims, 7 Drawing Sheets

LED LIGHTING DEVICE HAVING IMPROVED COOLING CHARACTERISTICS

BACKGROUND OF THE INVENTION

The present disclosure relates to the field of lighting sources, and more particularly relates to a replaceable LED light bulb usable in standard lighting fixtures.

Incandescent lighting bulbs produce considerable heat during lighting operations. Halogen based lighting also emits considerable non-visible infrared light. These conventional lighting products have low conversion efficiencies from electricity to light and waste significant amount of energies.

Light emitting diodes (LEDs) have several advantages compared to incandescent and halogen lights. LEDs emissions comprise a few narrow spectral ranges, which eliminates, to a large degree, wasted energy. LEDs have an extremely long life compared to incandescent and halogen bulbs. LEDs are solid state devices, which allow them occupy much less space than incandescent and halogen bulbs which require a sizeable vacuum bubble to prevent air from destroying the filament and to keep the glass or silica envelope from overheating. Whereas incandescent and halogen bulbs may have a life expectancy of 2000 hours before the filament fails, LEDs may last as long as 100,000 hours, with a typical life time at 5,000 hours. Furthermore, unlike incandescent and halogen bulbs whose hot filaments are prone to rupture, LEDs are not shock-sensitive and can withstand large forces without failure.

Although LEDs are more energy efficient than conventional lighting devices, cooling can still be a challenge because the LEDs, being small in dimensions, can generate considerable heat in a concentrated area near the LEDs. Insufficient cooling of the LEDs can overheat the LED devices and cause them to malfunction.

BRIEF SUMMARY OF THE INVENTION

In a general aspect, the present invention relates to an LED light bulb that includes a base member; one or more light emitting diodes mounted on the base member and in thermal communication with the base member, wherein the one or more light emitting diodes can emit light; and a top-mount member in thermal communication with the base member, wherein the top-mount member comprises a reflective surface that can reflect the light emitted by the one or more light emitting diodes, wherein the top-mount member comprising one or more cooling members that can dissipate heat generated by the one or more light emitting diodes to the ambient environment.

In another general aspect, the present invention relates to a lighting fixture that includes a fixture base; a lamp support mounted on the fixture base; and a LED lighting device. The LED lighting device includes an LED light bulb comprising: a base member; one or more light emitting diodes mounted on the base member and in thermal communication with the base member, wherein the one or more light emitting diodes can emit light under the control of an electric signal; and a top-mount member in thermal communication with the base member, wherein the top-mount member comprises a reflective surface that can reflect the light emitted by the one or more light emitting diodes, wherein the top-mount member comprising one or more cooling members that can dissipate heat generated by the one or more light emitting diodes to the ambient environment. A control unit can receive power from a power source and to produce the electric signal.

In yet another general aspect, the present invention relates to a lighting fixture that includes a fixture base; a lamp support mounted on the fixture base; a control unit that can receive power from a power source and to produce an electric signal; and an LED light bulb mounted on the lamp support. The LED light bulb includes a base member; one or more light emitting diodes mounted on the base member and in thermal communication with the base member, wherein the one or more light emitting diodes can emit light under the control of the electric signal; and a top-mount member in thermal communication with the base member, wherein the top-mount member comprises a reflective surface that can reflect the light emitted by the one or more light emitting diodes, wherein the top-mount member comprising one or more cooling members that can dissipate heat generated by the one or more light emitting diodes to the ambient environment. The LED light bulb can be mounted onto the lamp support.

Implementations of the system may include one or more of the following. The cooling member can include fins that can dissipate heat generated by the one or more light emitting diodes to the ambient environment. The fins are spaced apart and protruded outward from the top-mount member. At least some of the fins can be pointing upwards. The cooling member can include walls protruding out of the top-mount member, the walls being configured to dissipate heat generated by the one or more light emitting diodes to the ambient environment. The walls can be substantially parallel with each other. The walls can be spiral shaped or in the form of concentric circles. The reflective surface can be curved. The LED light bulb can further include a transparent cover surrounding the top-mount member to form a chamber to enclose the light emitting diodes, wherein the transparent member can pass the light emitted from the light emitting diodes. The transparent cover can include openings to allow air circulation in and out of the chamber during lighting operation. The top-mount member can be connected to a center portion of a surface of the base member. A plurality of LEDs can be mounted on a surface and around the top-mount member.

The disclosed system can include one or more of the following advantages. The disclosed LED lighting device is compatible with and can easily be mounted on the conventional lighting fixtures. The disclosed LED lighting device includes a cooling mechanism to effectively dissipate heat from the LEDs, which overcomes a key drawback in LED lighting devices. Not only the surface areas for heat dissipation are greatly increased by cooling members; the cooling members are also smartly positioned above the LEDs to allow hot air current to effectively receive and dissipate heat from the cooling members when hot air naturally moves up along the surface. As a result, the disclosed LED light device can operate more robustly without being affected by heat-related malfunctions.

Although the invention has been particularly shown and described with reference to multiple embodiments, it will be understood by persons skilled in the relevant art that various changes in form and details can be made therein without departing from the spirit and scope of the invention.

BRIEF DESCRIPTION OF THE DRAWINGS

The following drawings, which are incorporated in and from a part of the specification, illustrate embodiments of the present invention and, together with the description, serve to explain the principles of the invention.

DETAILED DESCRIPTION OF THE INVENTION

Figure 1:
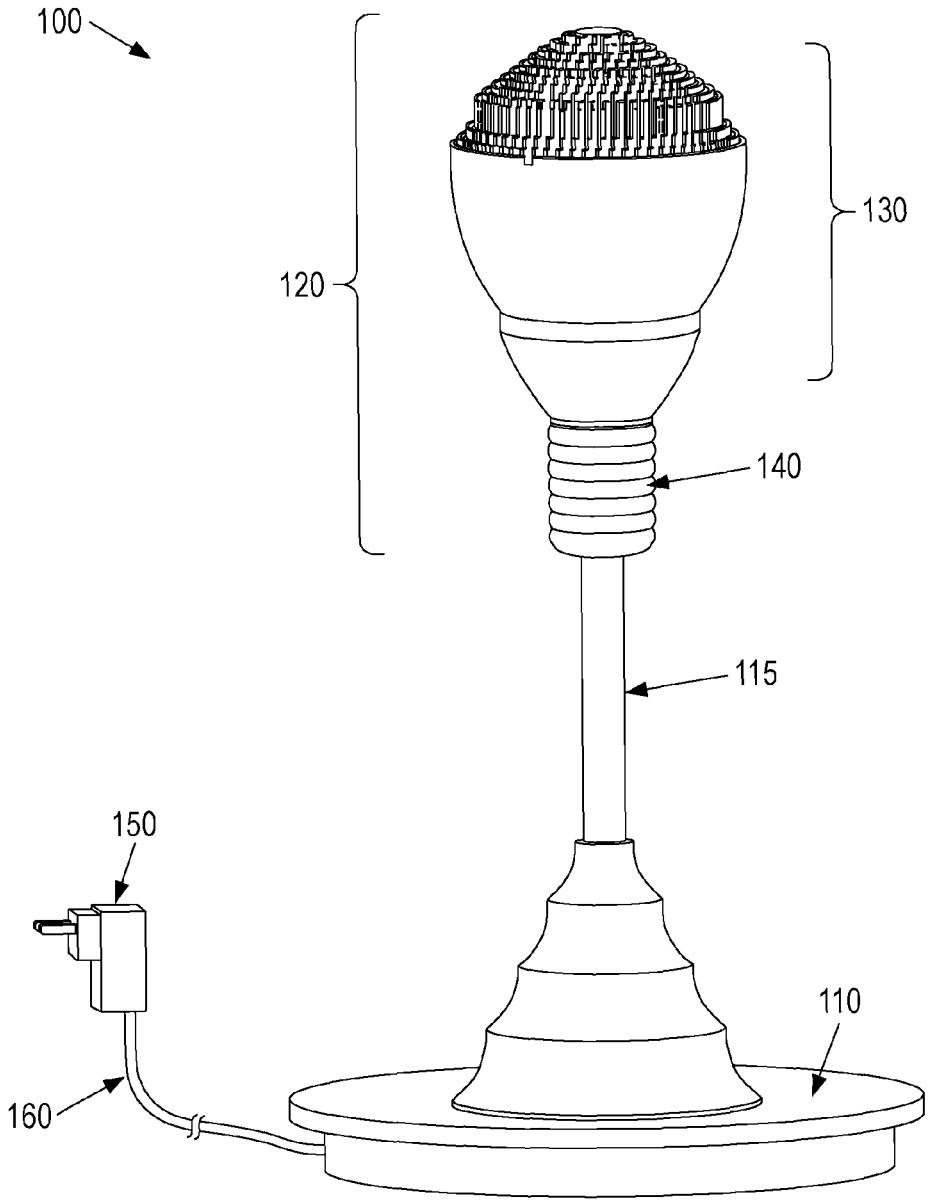
FIG. 1 illustrates a lighting fixture mounted with an LED lighting device in accordance with the present invention.

A lighting fixture 100, shown FIG. 1, includes a fixture base 110, a lamp support 115, and an LED lighting device 120 mounted on the lamp support 115. The lamp support 115 is typically a hollow tube. The LED lighting device 120 includes a LED light bulb 130 and a control unit 140. A power plug 150, a power cord 160, and a power cord (not shown) in the lamp support 115 can bring power from a socket in a wall to the LED lighting device 120.

Figure 2:
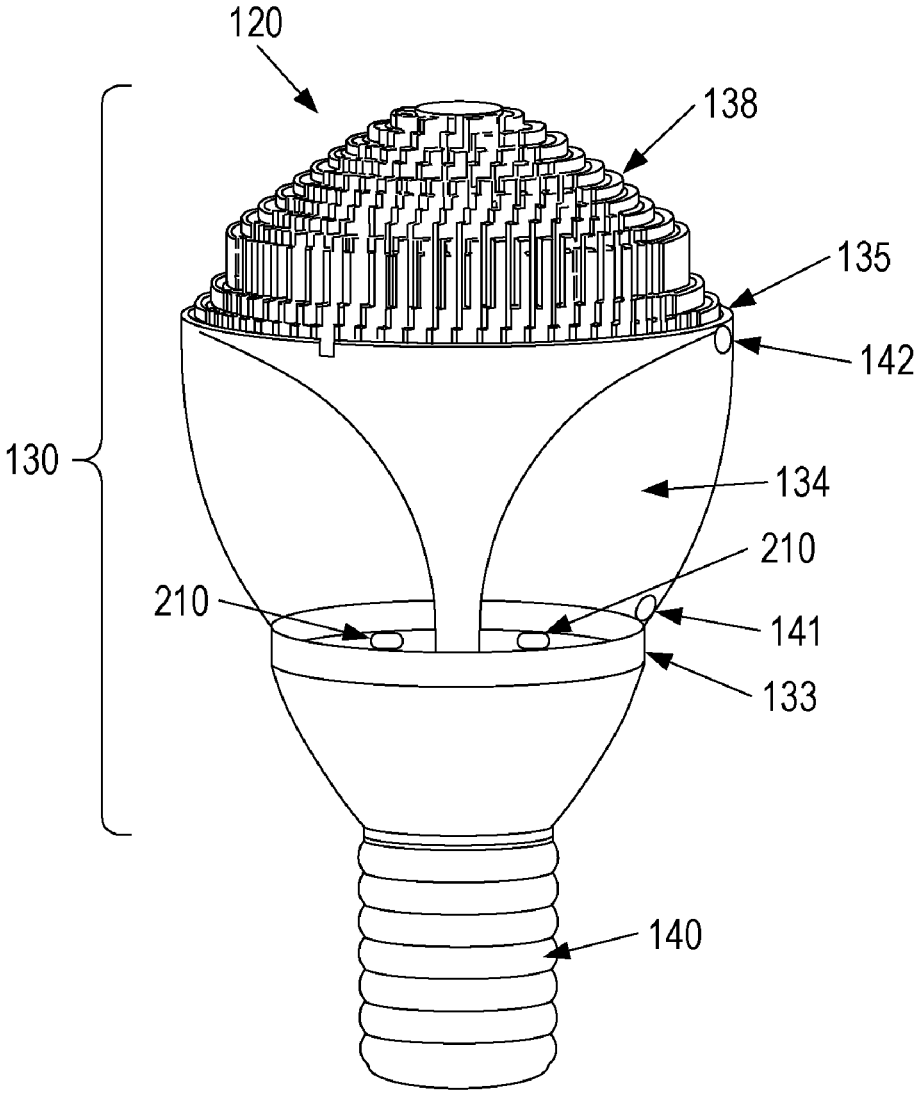
FIG. 2 is an enlarged view of the LED lighting device in FIG. 1.
Figure 3A:
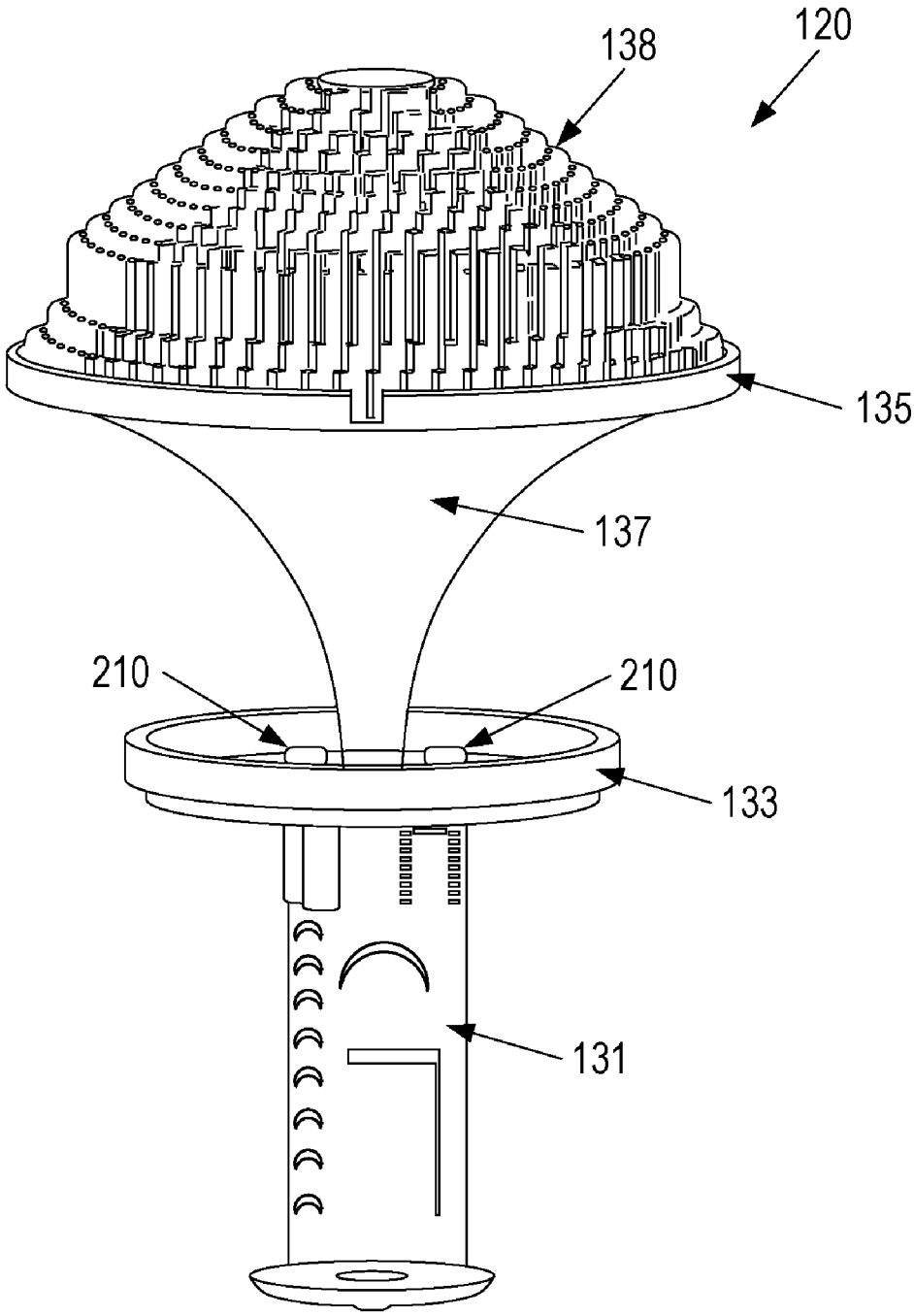
FIG. 3A a perspective side view of the LED lighting device of FIG. 1 with the transparent cover and the cover for the control unit removed.
Figure 3B:
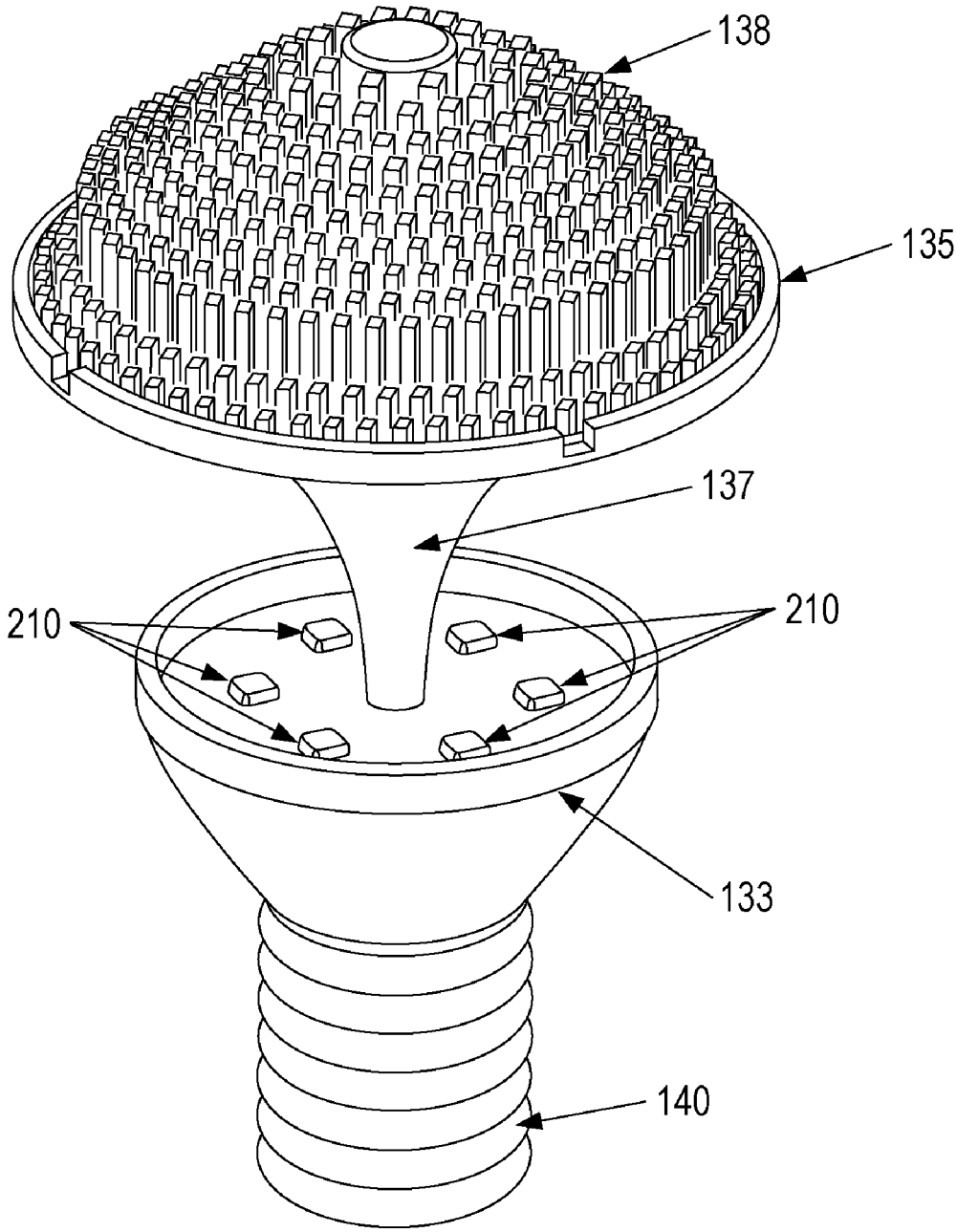
FIG. 3B is a perspective view of the LED lighting device with the transparent cover removed.

The LED lighting device 120, shown in FIGS. 2-3B, includes control electronics 131 in the control unit 140, a base 133 connected to the control unit 140, and a top mount member 135. One or more LEDs 210 mounted on the base 133 can be turned on by a switch under the control of an electric signal from the control unit 140, which is configured to receive power from a power source via the power plug 150 and the power cord 160. The control unit 140 can also include electric circuit for controlling the brightness and color temperatures of the light emitted by the LEDs 210. For example, the control unit 140 can provide pulse width modulations to the voltage or current pulses applied to the LEDs 210.

The control electronics 131 includes electric components to convert line voltage into a DC power supply, and to supply voltage to LEDs 210. The control electronics 131 can include a voltage transformation device (not shown) such as a rectifier to convert AC line voltage to DC voltage or current. The control electronics 131 can be positioned in the control unit 140 adjacent to the LED light bulb 130.

The top mount member 135 is connected to the top surface of the base 133, for example to the center portion of the base 133. The one or more LEDs 210 can be distributed around the center portion on the base 133, which reduces the concentration of heat sources. The top mount member 135 includes a reflective surface 137 configured to reflect the light emitted by the LEDs 215 to predetermined directions. For example, for a desk lamp, it is desirable to guide the emitted light downward toward the top surface of the desk such that the emitted light can illuminate the reading material without shining into a reader's eyes. The reflective surface 137 can be curved to project of the emitted light in a desirable area. For example, the reflective surface 137 can have a parabolic shape in at least a portion of its surface area. The reflective surface 137 can include a layer of a reflective material such as aluminum coating.

Figure 4:
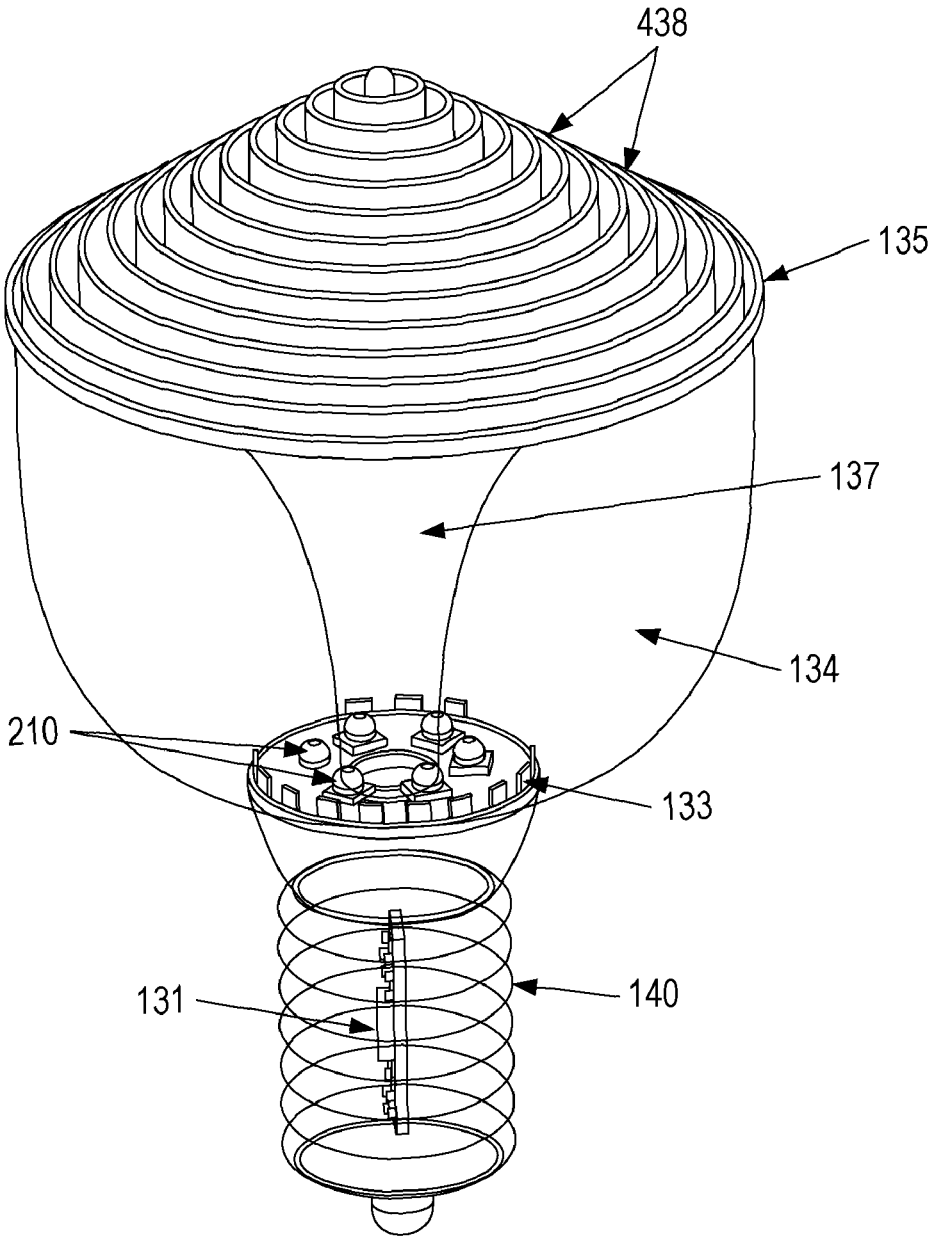
FIGS. 4 and 5 are perspective views of LED lighting devices having different cooling mechanisms.
Figure 5:
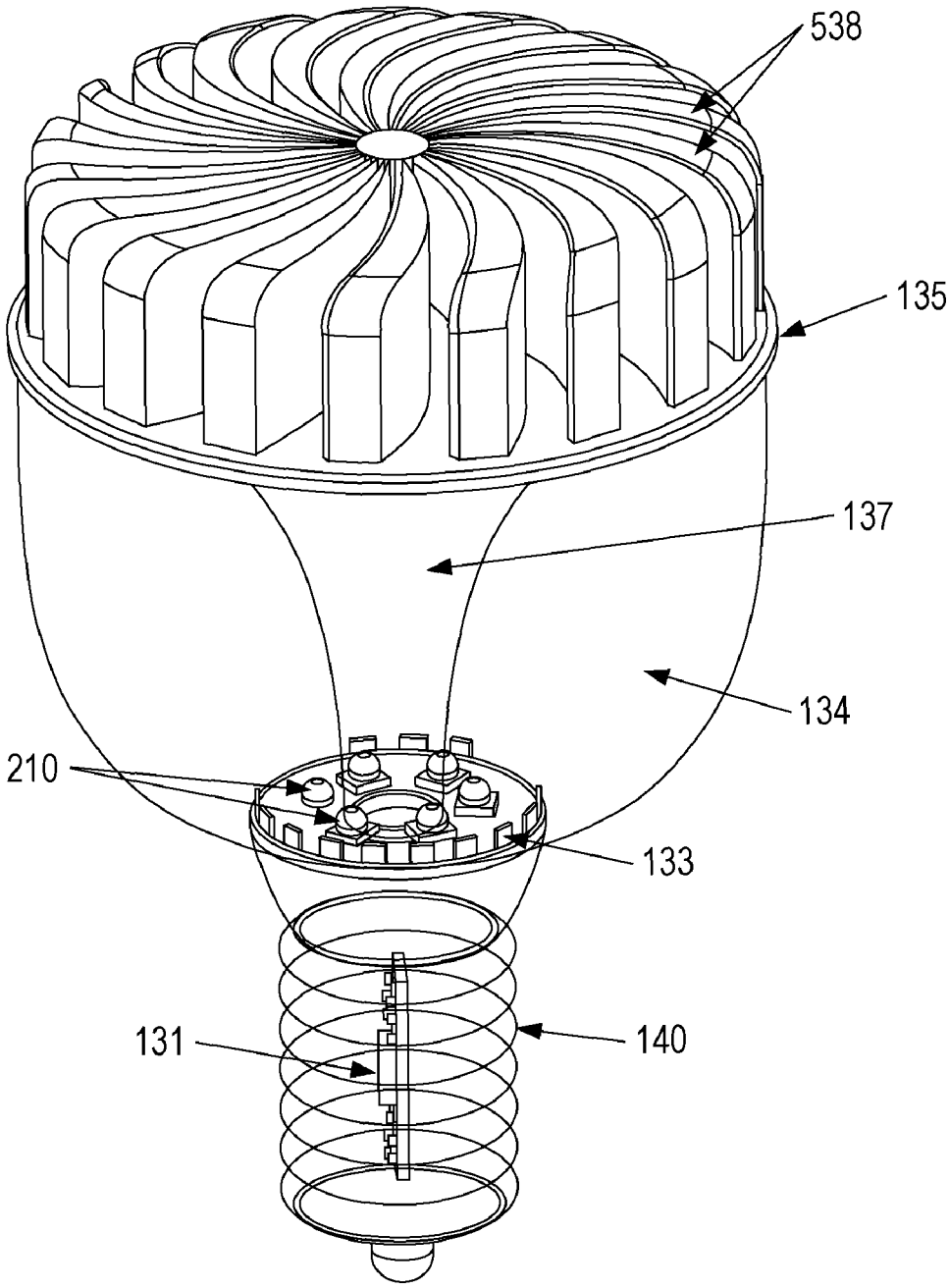

The top mount member 135 and the base 133 are heat conductors, which allow conduction of heat generated by the LEDs 210 during lighting operation. Suitable heat conducting materials for the top mount member 135 and the base 133 includes metals, conductive polymers and so on. The top mount member 135 further includes cooling fins 138 that are in thermal communication with the base and can effectively dissipate heat to the air in the ambient environment. The cooling fins 138 are spaced apart and protruded outward from the top-mount member 135. At least some of the cooling fins 138 are pointing upwards allow heat released by the surfaces to move upward and away from the top mount member 135. The cooling members can exist in many different forms without deviating from the present invention. For example, the cooling members 138 can include roughed surfaces, corrugated surfaces, protrusions, or fins on one or more surfaces of the top mount member 135. The top mount member 135 in the LED lighting device 120 can include different forms of cooling mechanisms such as cooling walls 438, 538 protruding out of the surface of the top mount member (as shown in FIGS. 4 and 5). The cooling walls can be substantially parallel to each other. The cooling walls 438 as shown in FIG. 4, have concentric circular shapes. The cooling walls 538, shown in FIG. 5, have spiral shapes. The adjacent cooling walls 438, 538 are separated by air gaps that allow increased surface area for heat dissipation and ventilation. The increased surface areas can increase thermal contact between the cooling members 138 and the surrounding air, which allows heat to be more efficiently carried away the heat generated by the LEDs 210. The top mount member 135 can include solid conducting material to allow heat transfer from the base 133 to the cooling members 138, 438, and 538 by heat conduction. The top mount member 135 can also include a hallow portion to decrease weight and material usage.

An advantage of the cooling fins 138 and the cooling walls 438, 538 is that they are positioned directly above the LED bulbs. Hot air current produced by the energy waste from the LED bulbs naturally moves up along the surfaces of the transparent cover 134 or through the openings 141, 142. The hot air currents can move through the gas between the cooling fins 138 and the cooling walls 438, 538 to effectively receive and dissipate heat from the cooling members. It was observed that this design configuration can effectively lower the temperature of the LED lighting device.

A transparent cover 134 is mounted around the top mount member 135 to enclose and protect the LEDs 210 while allowing the emitted light to pass. The transparent cover 134 can be made of glass or a transparent plastic material. Since the LEDs 210 are not required to be sealed in vacuum, the transparent cover 134 can provide openings 141 near the base 133 and openings 142 near the top edge in adjacent to the top mount member 135, which allow air circulation through the transparent cover 134 and to provide additional cooling to the LEDs 210. The inclusion of openings 141, 142 make the LED light bulb to be different from a conventional incandescent light bulb in which a vacuum is required in the sealed light bulb to protect the filament and to insulate heat produced by the filament.

In one aspect, heat generated by the LEDs 210 during operation can create upward air convection along the surface of the transparent cover 134. The air currents can move along the cooling members 138, 438, and 538 and more effectively remove heat from the cooling members 138 and the LED lighting device 120. In some embodiments, the LED light bulb 130 can have a substantially cylindrical symmetry around a central axis to emulate the shape of a conventional incandescent light bulb. The base 133, the transparent cover 134, and top-mount member 135 can each have a circular shape around the central axis.

In some embodiments, the control unit 140 is mounted onto to the lamp support 115 using a standard mount for conventional light bulbs, which can include any type of socket interfaces for the conventional incandescent "light bulbs", halogen light bulbs, or other standard light bulbs. The standard mount can include a threaded socket base to fit in a standard Edison screw-type light socket ("MES"), or other types of lighting interface, such as the halogen MR-16 socket, the canedelabra screw base, as used in nightlights and other small lights, the simple plug-in types used in strings of mini lights (e.g. for Christmas trees), the double contact bayonet cap ("BC"), and current halogen fittings G4, GY4, and R7s-75. The lamp support 115 can include a socket base for the control unit 140 to mount on. The standard mounting allows the LED lighting device 120 to be widely used in the conventional lighting fixtures without requiring special lighting fixtures. The LED light bulb 130 can further be separately mounted on the control unit 140, which allows the LED light bulb 130 to be separately replaced at the end of its life cycle, which lowers replacement cost at the end of LED devices' lifetime.

Figure 6:
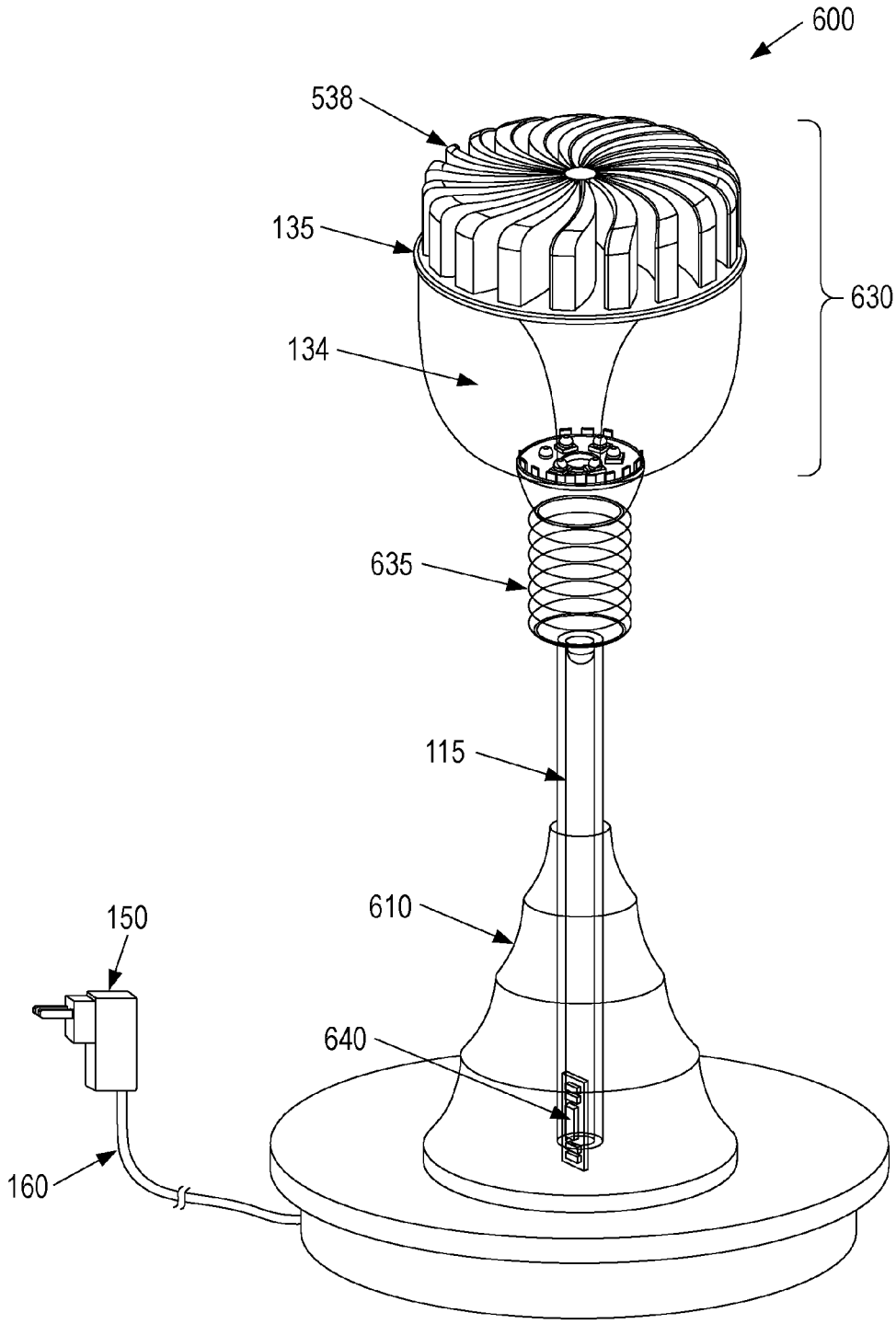
FIG. 6 illustrates another lighting fixture mounted with an LED lighting device in accordance with the present invention.

In some embodiments, referring to FIG. 6, a lighting fixture 600 includes a LED light bulb 630 mounted onto a socket base 635 that is affixed to the lamp support 115. A control unit 640 is positioned in the fixture base 610 instead of adjacent to the LED light bulb 630. The socket base 635 can be a standard mount for conventional light bulbs, which can include any type of socket interfaces for the conventional incandescent "light bulbs", halogen light bulbs, or other standard light bulbs. The standard mount can include a threaded socket base to fit in a standard Edison screw-type light socket ("MES"), or other types of lighting interface, such as the halogen MR-16 socket, the canedelabra screw base, as used in nightlights and other small lights, the simple plug-in types used in strings of mini lights (e.g. for Christmas trees), the double contact bayonet cap ("BC"), and current halogen fittings G4, GY4, and R7s-75. The electric voltage is supplied from the control unit 640 to the LED light bulb 630 through the lamp support 115. Similar to above, the LED light bulb 630 is replaceable by itself at the end of its lifetime, without the need to replace the control unit 640. Alternatively, the control unit 640 can also be disposed in the power plug 150.

In some embodiments, the control unit can be a separate component that the power cord can be plugged into. The control unit can be plugged into a wall socket. The lighting fixture can therefore be completely compatible with a conventional lighting fixture. To use a LED light source, all a user needs to do is to connect the control unit between the power cord and the wall socket, and replace a conventional light bulb by a LED light bulb. The combination of replaced LED light bulb and auxiliary control unit LED lighting to be retrofitted into conventional lighting fixtures, which allow immediate energy savings with existing infrastructure and minimum investment.

The disclosed system can include one or more of the following advantages. The disclosed LED lighting device is compatible with and can easily be mounted on the conventional lighting fixtures. The disclosed LED lighting device includes a cooling mechanism to effectively dissipate heat from the LEDs, which overcomes a key drawback in LED lighting devices. Not only the surface areas for heat dissipation are greatly increased by cooling members; the cooling members are also smartly positioned above the LEDs to allow hot air current to effectively receive and dissipate heat from the cooling members when hot air naturally moves up along the surface. As a result, the disclosed LED light device can operate more robustly without being affected by heat-related malfunctions.

It is understood that the disclosed LED light bulbs and LED lighting fixtures are compatible with other configurations without deviating from the spirit of the present invention. For example, the LED light bulb and top-mount member can be oriented upwards, obliquely, side ways, or downwards for different applications such as floor lamps, wall lights, or desk lamps. The mounting for the control units and the LED light bulb can include any conventional mounting format without deviating from the spirit of the present invention.

What is claimed is:

1. An LED light bulb, comprising:

a base member;

one or more light emitting diodes mounted on the base member and in thermal communication with the base member, wherein the one or more light emitting diodes are configured to emit light under the control of an electrical signal; and a top-mount member in thermal communication with the base member, wherein the top-mount member comprises a reflective surface configured to reflect the light emitted by the one or more light emitting diodes in predetermined directions, wherein the top-mount member comprises one or more cooling members configured to dissipate heat generated by the one or more light emitting diodes to the ambient environment, wherein the cooling member includes walls protruding out of the top-mount member, wherein the walls are spiral shaped or in the form of concentric circles, the walls being configured to dissipate heat generated by the one or more light emitting diodes to the ambient environment.

2. The LED light bulb of claim 1, wherein the cooling member includes fins configured to dissipate heat generated by the one or more light emitting diodes to the ambient environment.

3. The LED light bulb of claim 1, wherein the fins are spaced apart and protruded outward from the top-mount member, wherein at least some of the fins are pointing upwards.

4. The LED light bulb of claim 1, wherein the walls are substantially parallel with each other.

5. The LED light bulb of claim 1, further comprising a transparent cover surrounding the top-mount member to form a chamber to enclose the light emitting diodes, wherein the transparent member is configured to pass the light emitted from the light emitting diodes.

6. The LED light bulb of claim 5, wherein the transparent cover includes openings to allow air circulation in and out of the chamber during lighting operation.

7. The LED light bulb of claim 1, wherein the top-mount member is connected to a center portion of a surface of the base member, wherein a plurality of LEDs are mounted on the surface and surrounding the top-mount member.

8. A lighting fixture, comprising:

a fixture base;

a lamp support mounted on the fixture base; and a LED lighting device comprising:

an LED light bulb comprising:

a base member;

one or more light emitting diodes mounted on the base member and in thermal communication with the base member, wherein the one or more light emitting diodes are configured to emit light under the control of an electric signal; and a top-mount member in thermal communication with the base member, wherein the top-mount member comprises a reflective surface configured to reflect the light emitted by the one or more light emitting diodes, wherein the top-mount member comprising one or more cooling members configured to dissipate heat generated by the one or more light emitting diodes to the ambient environment; and a control unit configured to receive power from a power source and to produce the electric signal, wherein the control unit is configured to be mounted onto the lamp support using a socket mount selected from the group consisting of Edison screw-type light socket ("MES"), halogen MR-16 socket, the canedelabra screw base, the simple plug in, the double contact bayonet cap ("BC"), and a halogen fitting G4, GY4, or R7s-75.

9. The lighting fixture of claim 8, wherein the LED light bulb is configured to be dismounted from the control unit such that the LED light bulb is replaceable at the end of its lifetime.

10. The lighting fixture of claim 8, wherein the cooling member includes corrugated surfaces or fins configured to dissipate heat generated by the one or more light emitting diodes to the ambient environment.

11. The lighting fixture of claim 8, wherein the cooling member includes walls protruding out of the top-mount member, the walls being configured to dissipate heat generated by the one or more light emitting diodes to the ambient environment.

12. The lighting fixture of claim 11, wherein the walls are substantially parallel with each other.

13. A lighting fixture, comprising:

a fixture base;

a lamp support mounted on the fixture base;

a control unit configured to receive power from a power source and to produce an electric signal; and an LED light bulb mounted on the lamp support, the LED light bulb comprising:

a base member;

one or more light emitting diodes mounted on the base member and in thermal communication with the base member, wherein the one or more light emitting diodes are configured to emit light under the control of the electric signal; and a top-mount member in thermal communication with the base member, wherein the top-mount member comprises a reflective surface configured to reflect the light emitted by the one or more light emitting diodes, wherein the top-mount member comprising one or more cooling members configured to dissipate heat generated by the one or more light emitting diodes to the ambient environment, wherein the LED light bulb is configured to be mounted onto the lamp support using a socket mount selected from the group consisting of Edison screw-type light socket ("MES"), halogen MR-16 socket, the canedelabra screw base, the simple plug in, the double contact bayonet cap ("BC"), and a halogen fitting G4, GY4, or R7s-75, wherein the LED light bulb is configured to be dismounted from the lamp support such that the LED light bulb is replaceable at the end of its lifetime.

14. The lighting fixture of claim 13, further comprising:

a power cord configured to transmit the electric signal from the control unit to LED light bulb; and a power plug connected to the power cord, wherein the power plug is configured to be plugged into the control unit, wherein the control unit is configured to be connected to a wall socket to receive power.

15. The lighting fixture of claim 13, wherein the cooling member includes fins or walls configured to dissipate heat generated by the one or more light emitting diodes to the ambient environment.

* * * * *